US005954070A

United States Patent [19]

Abad et al.

[11] Patent Number: 5,954,070

[45] Date of Patent: Sep. 21, 1999

[54] FLUID APPLICATION AND CONCENTRATION MONITORING SYSTEM

[75] Inventors: Glen Silva Abad, La Habra; Ralph Edward Jaffke, Lakewood; Thomas William Jaeger, Norco; Brian McDonnell, Lakewood; Rick A. Osterman, Lomita, all of Calif.

[73] Assignee: Northrop Grumman Corporation, Los Angeles, Calif.

[21] Appl. No.: 09/127,876

[22] Filed: Jul. 31, 1998

[51] Int. Cl.[6] ..... B08B 3/02

[52] U.S. Cl. ..... 134/89; 134/104.2; 134/113; 134/172

[58] Field of Search ..... 134/88, 89, 95.3, 134/99.1, 103.3, 104.2, 113, 172

[56] References Cited

U.S. PATENT DOCUMENTS

| | | | |
|---|---|---|---|
| 1,508,828 | 9/1924 | Wholey | 134/89 |
| 2,593,256 | 4/1952 | Boyer | 134/111 |
| 3,416,544 | 12/1968 | Paiv | 134/102 |
| 4,056,114 | 11/1977 | Boutillette | 134/104 |
| 4,440,185 | 4/1984 | Wiltse | 134/104 |
| 4,637,413 | 1/1987 | Llewellyn et al. | 134/111 |
| 4,791,946 | 12/1988 | Cavanaugh et al. | 134/99.1 |
| 4,791,947 | 12/1988 | Holzberger | 134/172 X |
| 4,796,042 | 1/1989 | Mappin et al. | 134/113 X |
| 5,095,925 | 3/1992 | Elledge et al. | 134/61 |
| 5,143,102 | 9/1992 | Blaul | 134/113 X |
| 5,206,970 | 5/1993 | Johnson | 15/321 |
| 5,232,299 | 8/1993 | Hiss | 401/143 |
| 5,303,725 | 4/1994 | Hilgren | 134/56 |
| 5,464,033 | 11/1995 | Hartnell | 134/105 |
| 5,535,766 | 7/1996 | Edwards | 134/60 |

*Primary Examiner*—Philip R. Coe
*Attorney, Agent, or Firm*—Terry J. Anderson; Karl J. Hoch, Jr.

[57] ABSTRACT

In accordance with the present invention, there is provided portable fluid application and rinse apparatus for applying a first fluid and for rinsing with a second fluid. A first storage reservoir retains the first fluid and has an outlet. A first application conduit communicates with the outlet of the first storage reservoir. The first application conduit receives the first fluid from the outlet of the first storage reservoir and dispenses the first fluid therethrough. A first drain pan receives the first fluid. A second storage reservoir retains the second fluid and has an inlet and an outlet. A second application conduit communicates with the outlet of the second storage reservoir. The second application conduit receives the second fluid from the outlet of the second storage reservoir and dispenses the second fluid therethrough. A concentration measuring device measures the concentration of the second fluid. A second drain pan receives the second fluid and has a discharge port which communicates with the inlet of the second storage reservoir.

25 Claims, 1 Drawing Sheet

FLUID APPLICATION AND CONCENTRATION MONITORING SYSTEM

FIELD OF THE INVENTION

The present invention relates generally to the application systems of multiple fluids, and more particularly to a portable fluid application apparatus for applying fluids and monitoring the concentration of the fluids for reapplication.

BACKGROUND OF THE INVENTION

Portable parts washer systems, which have solvent recirculating subsystems, are well known in the art and are used for cleaning and decontamination processes of dirty, greasy parts and tools. Such systems and widely accepted in industries ranging from typewriter repair to aircraft maintenance shops. The patented art is replete with examples of parts washer systems. Most include a sink or drain pan which is mounted atop a cart or table for washing parts or work pieces therein. A solvent supply hose is directed over the parts by an operator. The resulting used solvent is contained in the sink which drains into a solvent supply tank. A pump is used for recirculating the solvent to the solvent supply hose. In order to increase the effectiveness of the recirculated solvent, many of the systems are provided with a filter for removing bulk contaminants from the solvent before it is reused.

The efficiency of these systems, however, is particularly lacking where the processing of the particular parts or work pieces require the application of multiple fluids. For example, in the aerospace industry, it is often desirable to apply a coating to a work piece for surface preparation purposes. Such a coating may be a conversion coating which is an intermediate coating for corrosion prevention. In practice, the conversion coating is applied to a part. Subsequently, the coated part is rinsed with a second fluid, such as water, to remove any excess conversion coating material. It is desirable to recirculate or recycle both the excess or used conversion coating fluid and the rinsing fluid as these fluids are treated as waste material when no longer effective for their intended use. Because of safety and regulatory reasons the fluid waste material must be specially handled and disposed of. Effective recirculation of the resulting fluids caught in the sink or drain pan of a prior art system, as described above, is significantly inefficient. Because the resulting fluid which is caught in a common drain pan, recycling of the fluid for use as the coating fluid is undesirable as it is quickly diluted by the rinse fluid. Conversely, recycling of the fluid for use as the rinse fluid is undesirable as it quickly contaminated with the coating fluid. In addition, where the coating and rinse fluids are chemically reactive, any such reaction may result in a degradation of the particular fluid's effectiveness.

While the prior art parts washers include recirculation systems which employ filtering devices, such filtering is limited to bulk contaminants, as is the case with degreasing dirty parts. Thus, filtering is simply accomplished by screening particulate matter from the recirculated fluid. Such a filtering scheme is ineffective in the case, described above, where two fluids are utilized. This is because the contaminant of interest is not a bulk material or particulate, but rather each fluid represents a contaminant to the other.

Another common example of where multiple fluids are utilized and recirculation of such fluids is desirable is where a part needs to undergo a surface preparation process for adhesion purposes. In this respect, a part may be exposed to an acidic or etchant solution which roughens the surface of the part. Thus, this processing facilitates improved adhesion of a subsequently applied coating, such as paint for example. During this process, after the acidic solution is applied, a second fluid is used to rinse the part of any excess solution as well as any dialoged material resulting from the acidic reaction with the part. Again, as in the conversion coating process, effective recirculation of the resulting fluids caught in the drain pan of a prior art system, as described above, is significantly inefficient. Because the resulting fluid which is caught in a common drain pan, recycling of the fluid for use as the acid solution is undesirable as it may be quickly diluted by the rinse fluid. Conversely, recycling of the fluid for use as the rinse fluid is undesirable as it may quickly become contaminated with the acid solution.

It is recognized that safety and environmental protection regulations are becoming a focus of attention. As such, it is therefore evident that there exists a need in the art for a multi-fluid system which facilitates the application of multiple fluids which are recirculated for improved effective reuse of the fluids prior to their disposal.

SUMMARY OF THE INVENTION

In accordance with the present invention, there is provided portable fluid application and rinse apparatus for applying a first fluid and for rinsing with a second fluid, wherein the second fluid has a monitored concentration and is collected for reapplication. As used herein, the fluids include solvents, solutions, etchants, coatings, paints, adhesives, and any other material which may be dispensed or applied. The apparatus is provided with a first storage reservoir which is formed to retain the first fluid therein and has an outlet. A first application conduit is provided in fluid communication with the outlet of the first storage reservoir. The first application conduit is formed to receive the first fluid from the outlet of the first storage reservoir and to dispense the first fluid therethrough. A first drain pan is provided which is formed to receive the first fluid therein. A apparatus is further provided with a second storage reservoir which is formed to retain the second fluid therein and has an inlet and an outlet. A second application conduit is provided in fluid communication with the outlet of the second storage reservoir. The second application conduit is formed to receive the second fluid from the outlet of the second storage reservoir and to dispense the second fluid therethrough. A concentration measuring device is provided in fluid communication with the second application conduit for measuring the concentration of the second fluid passing therethrough. A second drain pan is provided which is formed to receive the second fluid therein and has a discharge port in fluid communication with the inlet of the second storage reservoir. A apparatus is further provided with a movable housing which is formed to support the storage reservoirs and the drain pans thereon.

In practice, it is contemplated that it is desirable to apply the first fluid to a work piece. For example, the first fluid may be a solvent for surface preparation of the work piece and the second fluid may be water used to rinse any excess solvent from the work piece. It is contemplated that the solvent is applied to the work piece adjacent the first drain pan such that excess solvent is caught and allowed to drip or drain therein. Once the work piece is allowed to drain itself of excessive solvent, the operator may then position the work piece over the second drain pan. The second fluid, water, is then washed over the work piece in order to remove any excess solvent. The resulting used rinse water is caught in the second drain pan and flows through the discharge port. From the discharge port the rinse water enters the inlet of the second storage reservoir. Recirculation of the rinse water is effectuated when the water is pumped from the second storage reservoir and through the second application conduit for reapplication. The concentration measuring device is provided in fluid communication with the second application conduit and detects the level or concentration of the solution contained in the water. Upon reaching a predetermined solution concentration, the operator may properly dispose of the now used rinse water and replace it with a fresh supply.

In the preferred embodiment of the apparatus of the present invention, the first fluid is recirculated in the same manner as the second fluid. In this respect, the apparatus may be provided with its own dedicated concentration measuring device. Fluid pumps are provided for dispensing the fluids from their respective storage reservoirs. In particular, the fluid pumps are powered via pressurized air. Additionally, the housing may take the form of a wheeled cart or table.

As such, based on the foregoing, the present invention mitigates the inefficiencies and limitations associated with prior art recirculating fluid application devices. Significantly, the apparatus of the present invention is provided with adjacent first and second drain pans which mitigate contamination of the fluids by one another. Importantly, the apparatus is provided with at least one concentration measuring device. In this respect, a close control can be placed upon the useful or effectively life of the fluids prior to disposal and replacement.

Advantageously, the apparatus is designed with safety in mind. The apparatus may be used without reliance upon any external electricity which poses a safety hazard as fluids are being used. In this respect, the pumps are preferably pressurized air driven pumps. Such pressurized air may be provided via air hoses or even air tanks. In addition, the concentration measuring device may take the form a simple battery Ohm meter which senses the conductivity of the fluids as an indirect measure of concentration.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
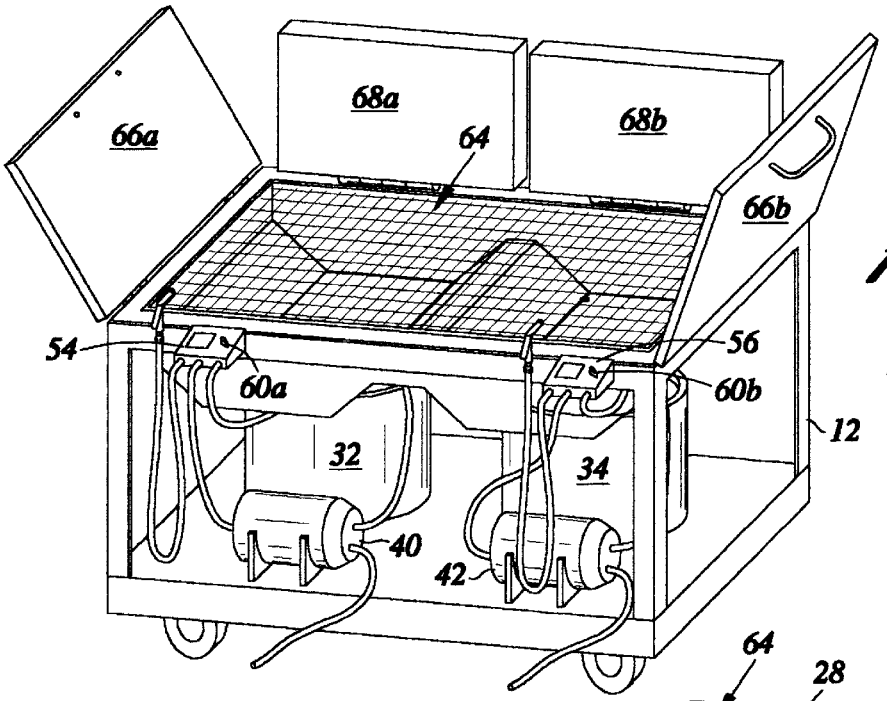
FIG. 1 is a perspective view of the fluid application and rinse apparatus of the present invention.
Figure 2:
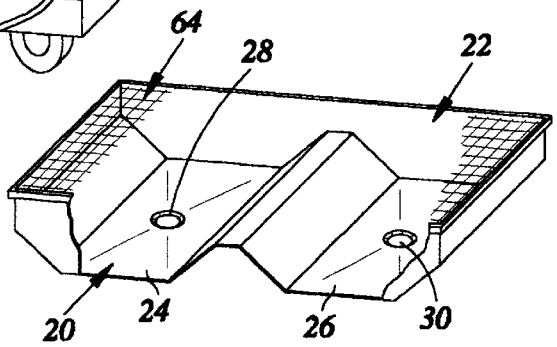
FIG. 2 is a perspective view of the drain pans of the apparatus shown in FIG. 1.
Figure 3:
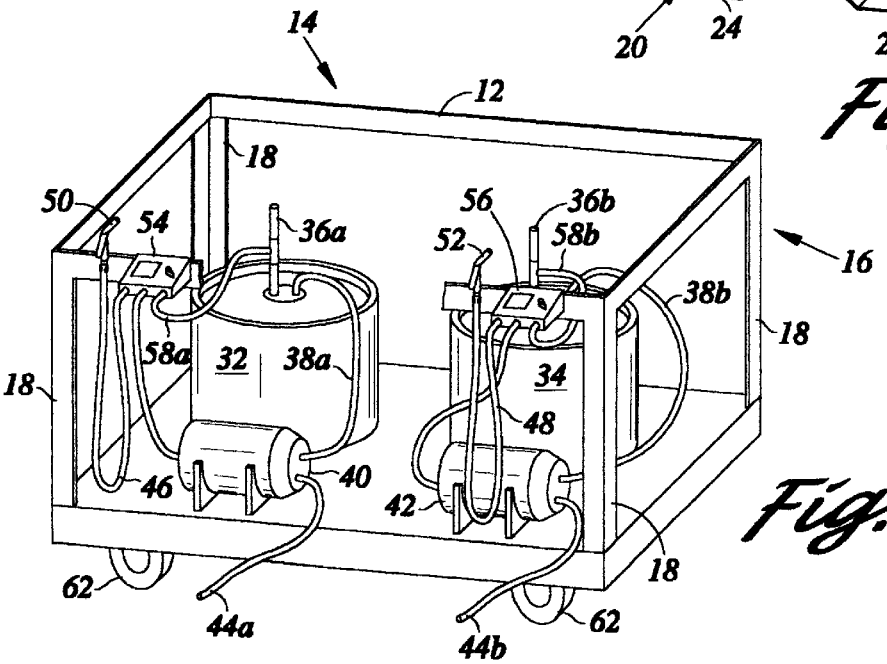
FIG. 3 is a partial perspective view of the lower portion of the apparatus shown in FIG. 1.

Referring now to the drawings wherein the showings are for purposes of illustrating a preferred embodiment of the present invention only, and not for purposes of limiting the same, FIGS. 1–3 illustrate a fluid application system of the present invention for monitoring the concentration of applied fluids which are collected for reuse.

In accordance with the present invention, there is provided portable fluid application and rinse apparatus 10 for applying a first fluid and for rinsing with a second fluid. As used herein, the fluids include solvents, solutions, etchants, coatings, paints, adhesives, and any other material which may be dispensed or applied. The apparatus 10 is generally defined by a housing 12. The housing 12 has an upper portion 14 and a lower portion 16 with vertical supports 18 interposed therebetween. First and second drain pans 20, 22 are mounted to the upper portion 14 of the housing 12. The drain pans 20, 22 generally take the form of a sink or basin. In this respect, the drain pans 20, 22 respectively have lower slanted surfaces 24, 26 which tend to urge fluids impinging thereon towards discharge ports 28, 30. Thus, the discharge ports 28, 30 function as drains for the drain pans 20, 22. The drain pans 22, 24 are disposed adjacent one another and may be formed of a single member. The drain pans 20, 22 may be aligned next to each other as shown in FIGS. 1 and 2 or one may be concentrically contained within the other. The drain pans 20*a,* 20*b* are preferably formed of stainless steel sheeting. As one of ordinary skill in the art can appreciate, the material used to form the drain pans 20, 22 should be generally non-reactive with the particular fluids utilized and is chosen from those which are well known to one of ordinary skill in the art.

The apparatus 10 provided with first and second storage reservoirs 32, 34 which are respectively formed to retain the first and second fluids therein. The reservoirs 32, 34 are preferably enclosed structures such as tanks or canisters. The storage reservoirs 32, 34 are supported by the lower portion 16 of the housing 12 and are thus disposed underneath the drain pans 20, 22. The storage reservoirs 32, 34 are respectively provided with inlets 36*a,* 36*b* and outlets 38*a,* 38*b*. The inlets 36*a,* 36*b* are sized and configured to be respectively connectable with the discharge ports 28, 30. In this respect, intermediate couplings and fittings may be used to facilitate such connection and are chosen from those which are well known to one of ordinary skill in the art.

The apparatus 10 is further provided with first and second fluid pumps 40, 42 which are respectively attached to the outlets 38*a,* 38*b* of the first and second storage reservoirs 32, 34. The pumps 40, 42 are sized and configured to pump the first and second fluids from the storage reservoirs 32, 34 and are chosen from those well known to one of ordinary skill in the art. Preferably, the pumps 40, 42 are driven or powered by pressurized gas, such as compressed air. Use of an air driven fluid pump avoids electrical safety hazards posed by electrical powered pumps operating near fluids. In practice, compressed air hoses 44*a,* 44*b* may be attached to the pumps 40, 42. Such compressed air hoses 44*a,* 44*b* are contemplated to be commonly available in many workshops.

Each pump 40, 42 respectively discharges in the first and second application conduits 46, 48 which preferably take the form of hoses or piping. The conduits 46, 48 may be fitted with nozzles 50, 52 for selectively dispensing the fluids therethrough. As used herein the nozzles 50, 52 include such devices as spray guns, spray wands, jets, faucets and other like devices which are well known to one of ordinary skill in the art. Where evaporation or containment of the fluids is of particular concern, the nozzles 50, 52 may be configured to dispense fluid at a low pressure and volume and without atomizing the fluids passing therethrough.

As is apparent from the above description, two separate fluid circuits are contemplated. The first encompasses the first drain pan 20 which drains into the first storage reservoir 32 from which the first fluid pump 40 draws the first fluid therefrom and through the first application conduit 46 and nozzle 50. The second encompasses the second drain pan 22 which drains into the second storage reservoir 34 from which the second fluid pump 42 draws the second fluid therefrom and through the second application conduit 48 and nozzle 52.

The apparatus 10 is further provided with first and second concentration measuring devices 54, 56 and are provided in respective fluid communication with the first and second application conduits 46, 48 for measuring the concentration of the first and second fluids passing respectively therethrough. Although the concentration measuring devices 54, 56 are depicted in the figures to be directly connected to the application conduits 46, 48, they may alternatively be disposed in the storage reservoirs 32, 34. The concentration measuring devices 54, 56 detect the concentration of the fluids. In this respect, preferably, the concentration measuring devices 54, 56 comprise Ohm meters which sense the conductivity of the fluids as an indirect measure of the fluid concentration. Other concentration measuring devices 54, 56 are contemplated which are chosen form those which are well known to one of ordinary skill in the art and may be a PH meter for example. Due to safety reasons, it is preferable that the concentration measuring devices 54, 56 are battery operated and thus external eletrical power is avoided.

Thus, the operator is contemplated to monitor the sensed concentration of the respective fluids and compare such measured concentrations with predetermined values. Where such predetermined values are met, the operator is contemplated to dispose of such fluid and handle as hazardous waste as appropriate. Advantageously, disposal of the fluids may be accomplished without disconnecting the various components as described above. Rather, it is contemplated that the fluids may be purged from the apparatus 10 by simply discharging the same via the nozzles 50, 52. Thus, the operator can simple dispense used fluid contained in the apparatus 10 by dispensing the same directly into waste containers.

Return hoses 58*a*, 58*b* may be provided which are respectively connected to the application conduits 46, 48 and feed back to the storage reservoirs 32, 34. The return hoses 58*a*, 58*b* have particular application where the pumps 40, 42 are driven at a constant rate, as is the case where the pumps 40, 42 are driven by a constant source of compressed air. In this respect, the return hoses 58*a*, 58*b* act to relieve built up in the system when the fluid is not being dispensed from the nozzles 50, 52. Return valves 60*a*, 60*b* may be provided in fluid communication with the return hoses 58*a*, 58*b* to selectably adjust flow therethrough.

It is preferable that the apparatus be portable. As such, the housing 12 is provided with wheels 62. In addition, the apparatus 10 may have a rack 64 which is disposed in spaced relation above the drain pans 20, 22 and formed to support a work piece thereat. Covers 66*a*, 66*b* may also be provided which are formed to enclose the drain pans 20, 22 thereunder when not in use. Additionally, a splash guard 68 may be attached to the housing 12 adjacent the drain pans 20, 22 for containing the fluids thereat.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A portable fluid application and rinse apparatus for applying a first fluid and for rinsing with a second fluid, wherein the second fluid has a monitored concentration and is collected for reapplication, the apparatus comprising:

a first storage reservoir formed to retain the first fluid therein and having an outlet;

a first application conduit in fluid communication with the outlet of the first storage reservoir, formed to receive the first fluid from the outlet of the first storage reservoir and to dispense the first fluid therethrough;

a first drain pan formed to receive the first fluid therein;

a second storage reservoir formed to retain the second fluid therein and having an inlet and an outlet;

a second application conduit in fluid communication with the outlet of the second storage reservoir, formed to receive the second fluid from the outlet of the second storage reservoir and to dispense the second fluid therethrough;

a concentration measuring device in fluid communication with the second application conduit for measuring the concentration of the second fluid passing therethrough;

a second drain pan formed to receive the second fluid therein and having a discharge port in fluid communication with the inlet of the second storage reservoir; and a movable housing formed to support the storage reservoirs and the drain pans thereon.

2. The apparatus of claim 1 wherein the concentration measuring device is configured to measure the conductivity of the second fluid.

3. The apparatus of claim 1 wherein the concentration measuring device is a battery operated device.

4. The apparatus of claim 1 further comprises a first and second fluid pumps, the first fluid pump in fluid communication with and interposed between the first storage reservoir and the first application conduit for pumping the first fluid from the first storage reservoir and through the first application conduit, the second fluid pump in fluid communication with and interposed between the second storage reservoir and the second application conduit for pumping the second fluid from the second storage reservoir and through the second application conduit.

5. The apparatus of claim 4 wherein the fluid pumps are driven by a pressurized gas.

6. The apparatus of claim 5 wherein the gas is air.

7. The apparatus of claim 1 wherein the housing generally comprises a table.

8. The apparatus of claim 7 wherein the housing having wheels.

9. The apparatus of claim 1 further comprising a rack disposed in spaced relation above the drain pans and formed to support a work piece thereat.

10. The apparatus of claim 1 further comprising a cover formed to enclose the drain pans thereunder.

11. The apparatus of claim 1 further comprising a splash guard attachable to the housing adjacent the drain pans for containing the fluids thereat.

12. The apparatus of claim 1 wherein the application conduits respectively have nozzles for selectively dispensing the fluids therethrough.

13. A portable fluid application and rinse apparatus for applying a first fluid and for rinsing with a second fluid, wherein the first fluid has a monitored concentration and is collected for reapplication, the apparatus comprising:

a first storage reservoir formed to retain the first fluid therein and having an inlet and an outlet;

a first application conduit in fluid communication with the outlet of the first storage reservoir, formed to receive the first fluid from the outlet of the first storage reservoir and to dispense the first fluid therethrough;

a concentration measuring device in fluid communication with the first application conduit for measuring the concentration of the first fluid passing therethrough;

a first drain pan formed to receive the first fluid therein and having a discharge port in fluid communication with the inlet of the first storage reservoir;

a second drain pan formed to receive the second fluid therein; and a movable housing formed to support the first storage reservoir and the drain pans thereon.

14. A portable fluid application and rinse apparatus for applying a first fluid, for rinsing with a second fluid, wherein the fluids have monitored concentrations and are collected for reapplication, the apparatus comprising:

first and second storage reservoirs respectively formed to retain the fluids therein and each having an inlet and an outlet;

first and second application conduits in respective fluid communication with the outlets of the storage reservoirs, respectively formed to receive the fluids from the outlets of the storage reservoirs and to dispense the fluids therethrough;

first and second concentration measuring devices in respective fluid communication with the application conduits for measuring the concentration of the fluids passing therethrough;

first and second drain pans respectively formed to receive the fluids therein and each having a discharge port in respective fluid communication with the inlets of the storage reservoirs; and a movable housing formed to support the storage reservoirs and the drain pans thereon.

15. The apparatus of claim 14 wherein the concentration measuring devices are configured to measure the conductivity of the fluids.

16. The apparatus of claim 15 wherein the concentration measuring devices are battery operated devices.

17. The apparatus of claim 14 further comprises a first and second fluid pumps, the first fluid pump in fluid communication with and interposed between the first storage reservoir and the first application conduit for pumping the first fluid from the first storage reservoir and through the first application conduit, the second fluid pump in fluid communication with and interposed between the second storage reservoir and the second application conduit for pumping the second fluid from the second storage reservoir and through the second application conduit.

18. The apparatus of claim 17 wherein the fluid pumps are driven by a pressurized gas.

19. The apparatus of claim 18 wherein the gas is air.

20. The apparatus of claim 14 wherein the housing generally comprises a table.

21. The apparatus of claim 20 wherein the housing having wheels.

22. The apparatus of claim 14 further comprising a rack disposed in spaced relation above the drain pans and formed to support a work piece thereat.

23. The apparatus of claim 14 further comprising a cover formed to enclose the drain pans thereunder.

24. The apparatus of claim 14 further comprising a splash guard attachable to the housing adjacent the drain pans for containing the fluids thereat.

25. The apparatus of claim 14 wherein the application conduits respectively have nozzles for selectively dispensing the fluids therethrough.

* * * * *